US005567378A

United States Patent [19]

Mochizuki et al.

[11] Patent Number: 5,567,378

[45] Date of Patent: Oct. 22, 1996

[54] MOLTEN METAL HOLDING FURNACE AND METHOD OF HOLDING MOLTEN METAL WITHIN THE SAME

[75] Inventors: Shunji Mochizuki, Nishinomiya; Hiromi Takagi; Masahiko Hoshino, both of Nagoya; Sumi Yoshikawa, Aichi-ken, all of Japan

[73] Assignee: Nippondenso Co., Ltd., Aichi-pref, Japan

[21] Appl. No.: 388,047

[22] Filed: Feb. 10, 1995

[30] Foreign Application Priority Data

Jun. 24, 1994 [JP] Japan ..... 6-142999

[51] Int. Cl.[6] ..... C21B 13/00

[52] U.S. Cl. ..... 266/44; 266/227; 266/275

[58] Field of Search ..... 266/227, 228, 266/242, 235, 216, 217, 275, 44

[56] References Cited

U.S. PATENT DOCUMENTS

| | | | |
|---|---|---|---|
| 4,054,275 | 10/1977 | Cole et al. | 266/216 |
| 4,290,588 | 9/1981 | Pelton | 266/235 |
| 4,332,373 | 6/1982 | Huppunen et al. | 266/228 |
| 4,401,295 | 8/1983 | Yoshida | 266/235 |
| 4,515,630 | 5/1985 | Tyler et al. | 266/216 |
| 4,638,980 | 1/1987 | Beele | 266/242 |
| 4,989,841 | 2/1991 | Tokumasu et al. | 266/217 |
| 5,268,020 | 12/1993 | Claxton | 266/235 |

FOREIGN PATENT DOCUMENTS 58-179541 10/1983 Japan .

*Primary Examiner*—Scott Kastler

*Attorney, Agent, or Firm*—Cushman Darby & Cushman, L.L.P.

[57] ABSTRACT

A holding furnace apparatus for holding molten metal and a molten metal holding method using the same are provided. The holding furnace includes generally a furnace body defining therein a reservoir chamber in which molten metal is held, an inlet port through which an ingot is supplied, an outlet port through which the molten metal held in the reservoir chamber is drawn outside, and an upper furnace wall defining the reservoir chamber together with the furnace body. The upper furnace wall has an inclined wall surface which is, when the reservoir chamber is filled with the molten metal at a given level, exposed to the molten metal so as to direct impurities contained in the molten metal rising to the surface of the molten metal to the inlet port.

2 Claims, 4 Drawing Sheets

MOLTEN METAL HOLDING FURNACE AND METHOD OF HOLDING MOLTEN METAL WITHIN THE SAME

BACKGROUND OF THE INVENTION

1. Technical Field of the Invention

The present invention relates generally to a holding furnace for holding metal molten and a method for holding molten metal therewithin, and more particularly to an improved structure of a holding furnace designed to eliminate contaminants contained in molten metal to produce high purity molten metal preparatory to casting and an improved metal holding method using the same.

2. Background Art

FIG. 6 shows a conventional molten metal holding furnace. A furnace body 68 defines therein a reservoir chamber holding molten metal. From an ingot inlet port 62 formed in an upper wall 61 of the furnace body 68, an ingot is supplied into the reservoir chamber, which is, in turn, heated by a heater 63 to produce molten metal. The molten metal is held at a given constant temperature. The level 64 of the molten metal is kept away from the heater 63 so that it is maintained even. Additionally, the level 64 of the molten metal varies once a portion thereof is drawn out of the reservoir chamber, thereby causing an air layer to be formed over the level of the molten metal. An agitator 65 is arranged which stirs the molten metal and ejects through its end inert gas, or so-called bubbling gas for reduction in hydrogen gas generated in the molten metal. The molten metal from which contaminants such as oxide have substantially been removed flows between barriers toward an outlet port along an arrow 67.

In the conventional molten metal holding furnace, the oxide produced from the molten metal is removed manually by a furnace operator. This is quite inconvenient. Additionally, since it is difficult to remove the oxide completely, castings may be contaminated with the oxide, thus resulting in degradation in quality thereof. Further, the heater is so arranged as to produce heat to the molten metal indirectly, thus leading to loss of heat energy.

SUMMARY OF THE INVENTION

It is therefore a principal object of the present invention to avoid the disadvantages of the prior art.

It is another object of the present invention to provide a holding furnace which is designed to remove impurities contained in molten metal to produce high purity molten metal.

According to one aspect of the present invention, there is provided a holding furnace apparatus for holding molten metal which comprises a furnace body defining therein a reservoir chamber in which molten metal is held, a port communicating with the reservoir chamber of the furnace body, and an upper furnace wall defining the reservoir chamber together with the furnace body, the upper furnace wall having an inclined wall surface which is exposed to the molten metal when the reservoir chamber is filled with the molten metal at a given level.

In the preferred mode of the invention, a heating means is further provided for heating the molten metal held in the reservoir chamber to a given temperature. The heating means is disposed within the molten metal. The heating means may be provided with a burner or an electric heater.

An inert gas generating means is further provided for generating inert gas to the molten metal held in the reservoir chamber for preventing oxidization. The inert gas generator is so disposed as to eject the inert gas to the surface of the molten metal through the port.

A shielding means is further provided for shielding the port from the air.

An agitator means is further provided for stirring the molten metal held in the reservoir chamber of the furnace body.

A filter means is provided for filtering out impurities contained in the molten metal. The filter means is so arranged as to allow the molten metal from which the impurities have been removed to be drawn out from the port.

A material supply means and material melting means are further provided. The material supply means supplies a solid material to the port. The material melting means melts the solid material supplied by the material supply means.

A level sensor and an ingot supply unit are further provided. The level sensor provides a level signal when the reservoir chamber is filled with the molten metal at the given level. The ingot supply unit supplies an ingot to the reservoir chamber through the port and is responsive to the level signal from the level sensor to stop supply of the ingot.

A contaminant remover means is further provided for removing contaminants from the surface of the molten metal. The contaminant remover means includes a skimming member which is operable to skim the molten metal to remove the contaminants contained therein. The skimming member is designed to extend through an opening formed in the furnace body over the surface of the molten metal held around the inlet port and to draw the contaminants out of the furnace body.

A return material supply means is further provided for supplying a return material to the reservoir chamber.

The reservoir chamber has a plurality of bottoms which are different in level from each other.

According to another aspect of the present invention, there is provided a holding furnace apparatus for holding molten metal which comprises a furnace body, a first molten metal reservoir chamber, defined in the furnace body, through which an ingot is supplied, a second molten metal reservoir chamber, defined in the furnace body, leading to the first molten metal reservoir, and a projecting portion formed between the bottoms of the first and second molten metal reservoir chambers. The second molten metal reservoir chamber has a bottom higher than a bottom of the first molten metal reservoir chamber.

According to a further aspect of the invention there is provided a holding furnace apparatus for holding molten metal which comprises a furnace body, a first molten metal reservoir chamber defined in the furnace body, a second molten metal reservoir chamber defined in the furnace body, a furnace wall formed between the first and second molten metal reservoir chambers, and a fluid passage formed to direct the molten metal held on a bottom of the first molten metal reservoir chamber to the second molten metal reservoir chamber.

In the preferred mode, a filter is further disposed in the fluid passage for filtering out impurities contained in the molten metal.

A molten metal outlet port and a cover are provided. The outlet port is formed in the furnace body communicating with the second molten metal reservoir chamber. The cover is provided to cover the molten metal outlet port.

A third molten metal reservoir chamber is further provided which communicates with the second molten metal reservoir chamber and into which an ingot is supplied. The third molten metal reservoir chamber has a bottom higher than a bottom of the second molten metal reservoir chamber. The second molten metal reservoir chamber has upper and lower bottoms which are different in level from each other.

According to a still further aspect of the invention, there is provided a holding furnace apparatus for holding molten metal which comprises a furnace body defining therein a reservoir chamber in which molten metal is held, an inlet port, through which an ingot is supplied, communicating with the reservoir chamber of the furnace body, an outlet port through which the molten metal held in the reservoir chamber of the furnace body is drawn out of the holding furnace apparatus, and an upper furnace wall defining the reservoir chamber together with the furnace body. The upper furnace wall has an inclined wall surface which is, when the reservoir chamber is filled with the molten metal at a given level, exposed to the molten metal. The inclined wall surface is geometrically oriented to direct impurities contained in the molten metal rising to the surface of the molten metal to the inlet port.

According to a yet further aspect of the invention, there is provided a holding furnace apparatus for holding molten metal which comprises a furnace body defining therein a reservoir chamber in which molten metal is held, an upper furnace wall defining the reservoir chamber together with the furnace body, the upper furnace wall having a wall surface which is substantially exposed to the molten metal, and an inert gas generator for generating inert gas to rising oxide in the molten metal toward the surface of the molten metal.

According to a further aspect of the present invention, there is provided a method for holding molten metal within a furnace which comprises the steps of setting a level of molten metal in the furnace to a given level at which an upper wall of the furnace is exposed to a surface of the molten metal, and generating inert gas in the molten metal, whereby oxide in the molten metal rises to the surface of the molten metal.

BRIEF DESCRIPTION OF THE DRAWINGS

The present invention will be understood more fully from the detailed description given hereinbelow and from the accompanying drawings of the preferred embodiment of the invention, which, however, should not be taken to limit the invention to the specific embodiment but are for the purpose of explanation and understanding only.

In the drawings.

DESCRIPTION OF THE PREFERRED EMBODIMENT

Figure 1:
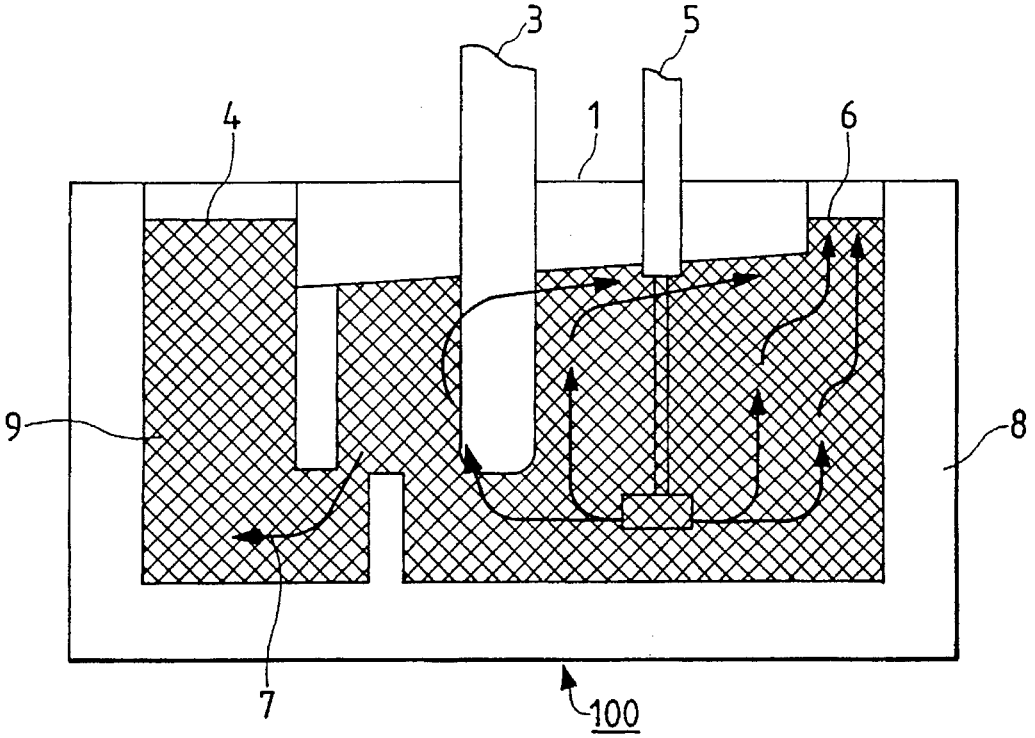
FIG. 1 is a cross sectional view which shows a holding furnace apparatus according to the present invention.

Referring now to the drawings, wherein like numbers refer to like parts in several views, particularly to FIG. 1, there is shown a molten metal holding furnace apparatus 100 according to the present invention.

The molten metal holding furnace apparatus 100 includes a furnace body 8, an upper wall 1, heater 3, and an agitator 5. The furnace body 8 is made of a ceramic material, and defines a reservoir chamber 9 together with the upper wall 1. The upper wall is made of material such as sillimanite, and forms therein a groove, or inlet port 6 into which ingots are supplied and an outlet port 4 through which molten metal is drawn out of the reservoir chamber 9. Additionally, from the inlet port 6, contaminants such as oxide are removed outside the reservoir chamber 9. The upper wall, as clearly shown in the drawing, also has an inclined or tapered bottom wall exposed to or immersed in the molten metal held in the reservoir chamber 9. The tapered bottom wall is so arranged as to have a thin-walled end portion lead to the inlet port 6. The heater 3 and the agitator 5 are inserted into the molten metal held in the reservoir chamber 9 through the upper wall 1. The heater 3 has an outer wall made from a material such as $Si_3N_4$. The agitator 5 not only stirs the molten metal, but also jets inert gas out of its end portion for reduction in hydrogen gas contained in the molten metal. The activities of the agitator 5 and the inert gas discharged therefrom, thus, cause the oxide and the hydrogen gas to rise to the surface of the molten metal, which are, in turn, collected to the inlet port 6 along the tapered bottom wall of the upper wall 1. The collected oxide and the hydrogen gas are discharged out of the holding furnace apparatus 100 cyclically. In this way, the contaminants are collected in a direction opposite the outlet port 4, so that high purity molten metal excluding the contaminants is held around the outlet port 4.

Figure 2:
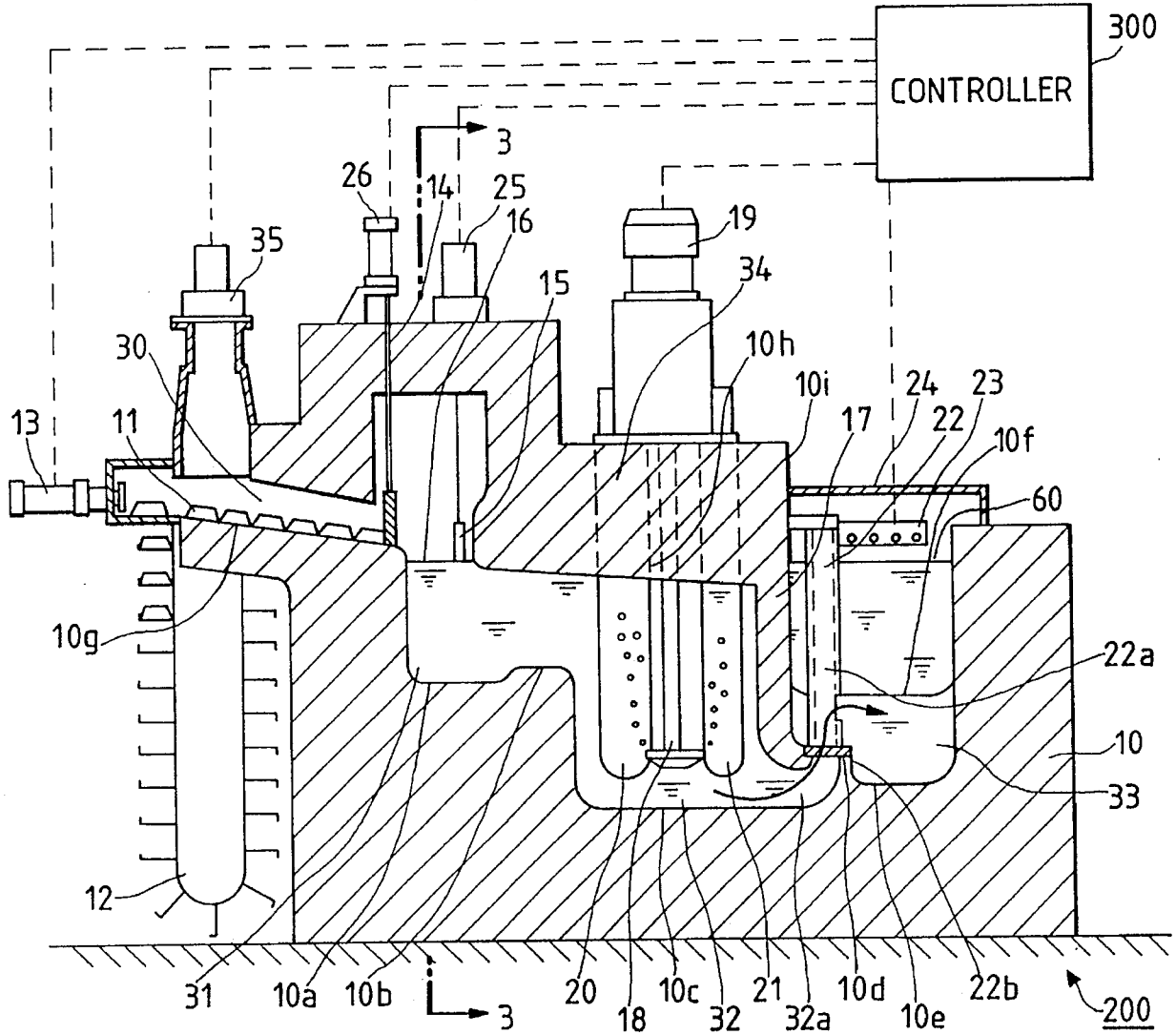
FIG. 2 is a cross sectional view which shows an alternative embodiment of a holding furnace apparatus of the invention.
Figure 3:
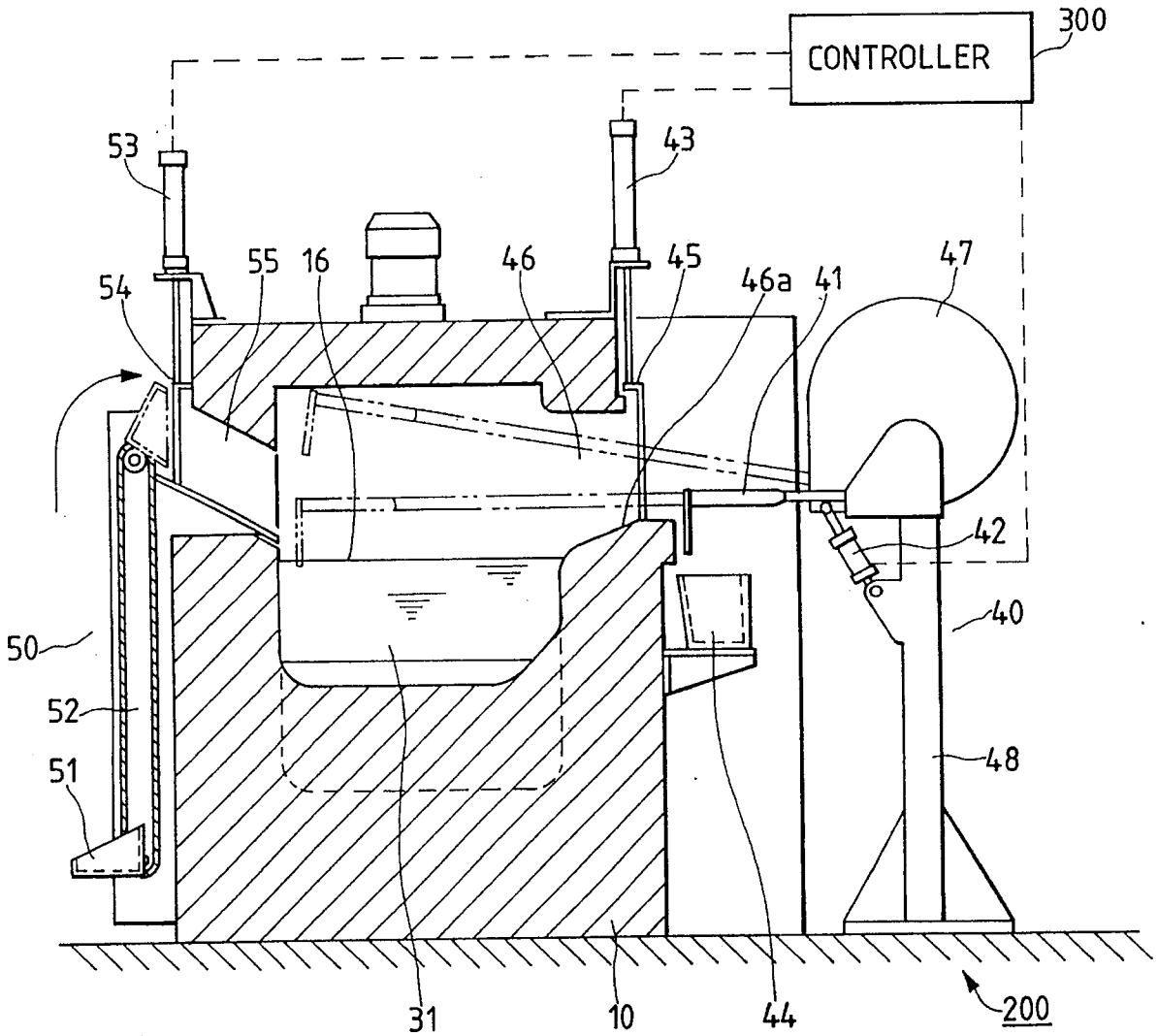
FIG. 3 is a cross sectional view taken along the line 3—3 in FIG. 2.

FIGS. 2 and 3 show an improvement on the holding furnace apparatus of the invention.

Shown is a holding furnace apparatus 200 designed to melt aluminum ingots to hold it at a temperature of about 650° to 750° C. The holding furnace apparatus 200 has a melting capacity of about 150 Kg per hour and ability to hold molten metal of approximately 1600 Kg.

The holding furnace apparatus 200 includes a furnace body 10 made of a ceramic material. The furnace body 10 defines therein first, second, and third reservoir chambers 31, 32, and 33 which hold therein molten metal, and have different depths as clearly shown in the drawing. The furnace body 10 has also formed therein an ingot inlet port 30 having a bottom wall 10*g* inclined toward an upper portion of the first reservoir chamber 31 for smooth sliding motion of ingots 11 into the first reservoir chamber 31. In an inner opening of the ingot inlet port 30, an ingot stopper plate 14 is arranged which is so controlled by an ingot-dropping cylinder 26 as to be lifted vertically for allowing the ingots 11 to be dropped into the first reservoir chamber 31. The ingot stopper plate 14 usually closes the ingot inlet port 30 for shutting off the molten metal from the air for preventing oxidization and preventing impurities to be mixed with the molten metal.

The ingots are, as shown in FIG. 2, placed in alignment with each other on the inclined bottom wall 10*g*. Provided outside the ingot inlet port 30 is an ingot supply cylinder 13 which pushes the outermost ingot to drop the innermost ingot into the first reservoir chamber 31.

An ingot conveyer 12 is arranged beneath the ingot inlet port 30 which feeds the ingots 11, in sequence, toward the front of the ingot supply cylinder 13. The ingot conveyer 12 includes a conveyer belt which is driven by a motor (not shown) to move vertically. The conveyer belt has disposed thereon a plurality of carriers 12*a* for receiving the ingots 11 supplied manually or automatically.

A burner 25 is mounted in the furnace body 10 which throws flames toward the ingots 11 dropped in the first reservoir chamber 31 at an initial stage of a melting process for melting them. An exhaust flue 35 is so mounted as to communicate with the ingot inlet port 30 for discharging the heat produced during melting of the ingots 11 out of the furnace apparatus 200.

A level sensor 15 is disposed at a molten metal upper limit level 16 within the first reservoir chamber 31. The level sensor 15 includes electrodes which are operable to provide a level signal when the first reservoir chamber 31 is filled with the molten metal at the molten metal upper limit level 16.

The first reservoir chamber 31 has a projecting bottom 10*b* formed between a bottom wall 10*a* and the second reservoir chamber 32. The second reservoir chamber 32 has a bottom wall 10*c* lower than the bottom wall 10*a* of the first reservoir chamber 31.

An agitator 18 is inserted into the second reservoir chamber 32 through an upper furnace wall 34. A drive motor 19 is provided to actuate the agitator 18 for stirring molten metal held in the second reservoir chamber 32 at a constant speed. The agitator 18 forms in its end holes for ejecting inert gas such as Ar or $N_2$ for reduction in hydrogen gas produced in the molten metal. The inert gas is introduced from an external through a gas passage formed in an shaft of the agitator 18.

Inserted through the upper furnace wall 34 into the second reservoir chamber 32 are a dipping burner 20 and a dipping electric heater 21 for auxiliary heating.

The upper furnace wall 34 has an inclined bottom wall 10*h* sloping from the first reservoir chamber 31 to the second reservoir chamber 32. The entire surface of the inclined bottom wall 10*h* is located below the molten metal upper limit level 16 so that it may be immersed in the molten metal.

Between the second and third reservoir chambers 32 and 33, a barrier 17 is formed which extends from the upper furnace wall 34 near the bottom wall 10*c* of the second reservoir chamber 32 to form a fluid passage 32*a* communicating between the first and second reservoir chambers 32 and 33.

The third reservoir chamber 33 has an opening, or outlet port 60 through which molten metal is drawn outside the third furnace chamber 33 preparatory to casting. The outlet port 60 is enclosed by a cover 24 openable through a driver (not shown) for minimizing the exposure of the molten metal to the air.

In the fluid passage 32*a*, a filter 22 is fitted through which the molten metal held in the second reservoir chamber 32 flows into the third reservoir chamber 33. The filter 22 includes a hollow cylindrical retainer 22*a* and a ceramic filter plate 22*b* secured on an end of the retainer. The ceramic filter plate 22*b* is designed to filter out fine impurities in the molten metal flowing therethrough. The ceramic filter plate 22*b* is installed in tight engagement with a peripheral wall of the fluid passage 32*a*. The retainer 22*a* partially projects at its upper end from the surface of the molten metal, and is supported by a side wall 10*i* of the upper furnace wall 34. Therefore, the replacement of the filter 22 may easily be accomplished by opening the cover 34 and lifting up the upper end of the retainer 22*a* without drawing the molten metal out of the third reservoir chamber 33.

The third reservoir chamber 33 has two bottoms: an upper bottom 10*f* and a lower bottom 10*e* lower than the upper bottom 10*f* by a given height. An inert gas generator 23 is disposed in the outlet port 60 which ejects inert gas such as Ar or $N_2$ to shield the molten metal held in the third reservoir chamber 33 from the flesh air. The inert gas generator 23 may also be so provided as to produce the inert gas around the surface of the molten metal held in the first reservoir chamber 31.

In operation, the burner 35 is first activated to melt the ingots 11 dropped in the first reservoir chamber 31. When the ingots are melted and its level reaches the molten metal upper limit level 16, it will cause the level sensor 15 to provide a level signal to the controller 300. The controller 300 then issues a stop command to the ingot supply cylinder 13 to stop the supply of the ingots 11.

When the level of the molten metal has reached the molten metal upper limit level 16, the dipping burner 20 heats the molten metal to a given temperature of about 650° to 750° C.

Usually, the heating control of the molten metal is performed only using the dipping burner 20. It is, however, dangerous to leave the dipping burner 20 activated when a furnace operator cannot observe the furnace apparatus 200 on a holiday for example. Thus, in this case, it is useful to heat the molten metal through the electric heater 21 instead of the dipping burner 20 for operating the furnace apparatus 200 continuously in safety. This is also effective in saving energy.

The agitator 18 is actuated by the controller 300 to stir the molten metal and eject inert gas thereinto, thereby causing oxide and hydrogen gas contained in the molten metal to rise to the surface. The oxide and hydrogen gas are then collected along the inclined bottom wall 10*h* to the level of the molten metal held in the first reservoir chamber 31, which are, in turn, removed out of the furnace apparatus 200 by an automatic contaminant remover device as will be discussed in detail later.

The molten metal in the second reservoir chamber 32 from which the contaminants have been removed by the agitator 18, then flows through the filter 22 to the third reservoir chamber 33 so that fine impurities are filtered out. The use of a filter in a furnace is generally known in the art, but it is difficult to put it into practical use because the filter will clog easily when there are much oxide in molten metal. This problem is, however, easily solved by passing the molten metal through the filter 22 after a certain amount of oxide is, as discussed above, removed by the agitator 18.

If the molten metal still contains therein fine impurities after having passed through the filter 22, they will precipitate on the lower bottom 10*e* of the third reservoir chamber 33, so that high purity molten metal is led to the outlet port 60. When the molten metal is drawn from the outlet port 60 preparatory to casting, it is preferable to open the cover 24 and ladle a desired amount of the molten metal held above the upper bottom 10*f*. While the cover 24 is opened, the inert gas generator 23 ejects inert gas around the outlet port 60 so that the molten metal held in the third reservoir chamber 33 is shielded from the fresh air for avoiding oxidization.

After the ladling operation is completed, the cover 24 is closed for preventing the surface of the molten metal near the outlet port 60 from being exposed to the fresh air.

Once the molten metal is ladled out, the level of the molten metal held in the first reservoir chamber 31 will be lowered away from the level sensor 15, causing the level sensor 15 to provide an OFF signal to the controller 300. The controller 300 then outputs ingot supply commands to the ingot supply cylinder 13 and the conveyer 12 so that additional ingots are automatically transported in sequence to the ingot inlet port 30 and then supplied by the ingot supply cylinder 13 into the first reservoir chamber 31. In this way, the level of the molten metal held in the first reservoir chamber 31 is maintained constant automatically. This will also serve to reduce the variation in temperature in the reservoir chambers, thereby allowing capacities of the dipping burner 20 and the electric heater 21 to be decreased for energy saving.

The additional ingots supplied into the first reservoir chamber 31 sink onto the bottom wall 10*a* and then are subjected to heat produced by the molten metal therearound and the dipping burner 20 so that they are melted completely. The bottom wall 10*a* of the first reservoir chamber 31 higher than the bottom wall 10*c* of the second reservoir chamber 32 and the projecting bottom 10*b* serve to cause most of impurities contained in the ingots to be deposited on the bottom wall 10*a*, thereby preventing them from entering the second reservoir chamber 32.

As apparent from the above, the provision of the plurality of reservoir chambers 31, 32, and 33 enables removal of impurities inevitably contained in the ingots 11 in stepwise fashion for supplying high purity molten metal.

Figure 6:
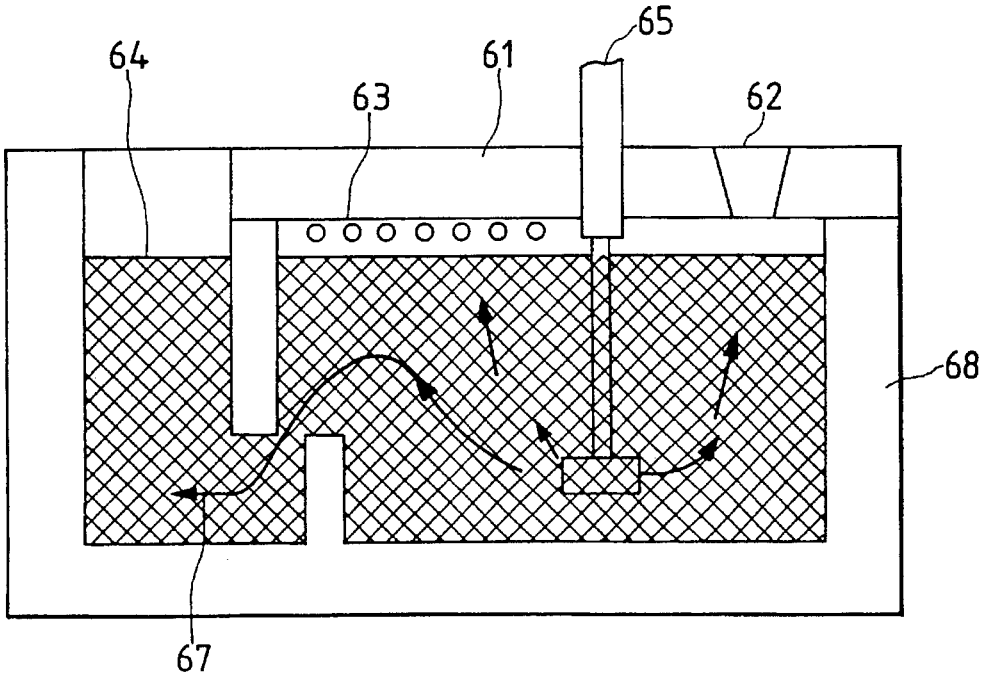
FIG. 6 PRIOR ART
FIG. 6 is a cross sectional view which shows a conventional furnace apparatus.
Figure 4:
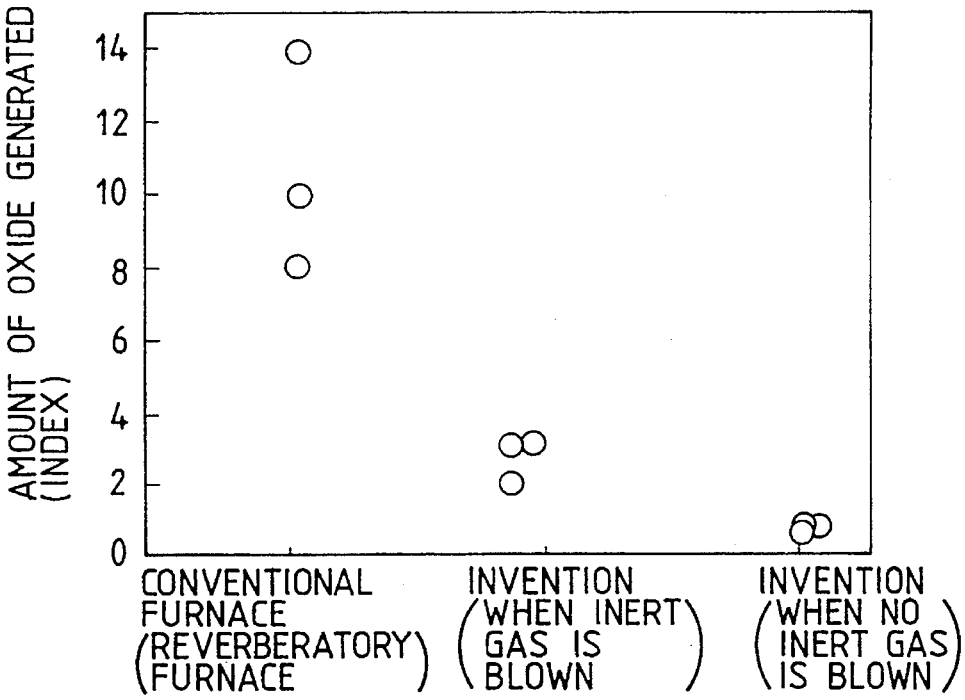
FIG. 4 is a graph which shows a difference in the amount of oxide produced in molten metal between a conventional furnace apparatus shown in FIG. 6 and a holding furnace apparatus of the invention shown in FIG. 2.

FIG. 4 shows a difference in the amount of oxide produced in molten metal between the conventional furnace shown in FIG. 6 and the holding furnace apparatus 200 shown in FIG. 2. The graph shows that the amount of oxide produced in the holding furnace apparatus 200 is greatly decreased.

Figure 5:
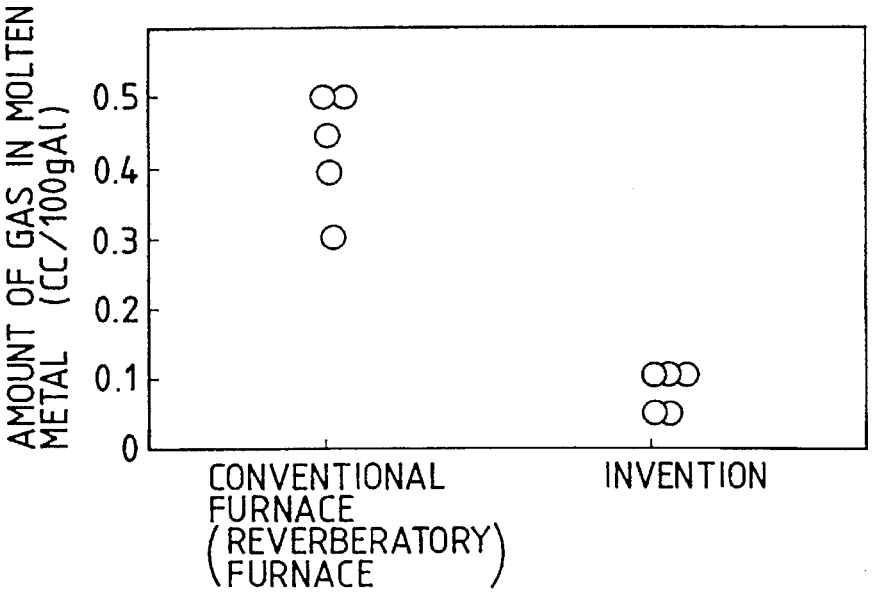
FIG. 5 is a graph which shows a difference in the amount of gas generated in molten metal between a conventional furnace apparatus shown in FIG. 6 and a holding furnace apparatus of the invention shown in FIG. 2.

FIG. 5 shows a difference in the amount of gas generated in molten metal between the conventional furnace shown in FIG. 6 and the holding furnace apparatus 200. The graph shows the amount of gas generated in the holding furnace apparatus 200 of the invention is smaller than that generated in the conventional furnace.

Referring back to FIG. 3, there is shown an automatic contaminant remover device 40 for eliminating contaminants such as oxide collected on the surface of the molten metal held in the first reservoir chamber 31 and a return material supply device 50 for supplying a return material such as surplus castings.

FIG. 3 is a cross sectional view taken along the line 3—3 in FIG. 2. The contaminant remover device 40 includes a blade spring having disposed on its end a skimming plate 41. The blade spring is rolled up within a drum 47. The drum 47 is mounted by a support 48 on a furnace base, and designed to be swung by a cylinder 42.

The furnace body 10 forms therein an opening 46 leading to the first reservoir chamber 31. The skimming plate 41 is designed to be telescopically inserted through the opening 46 into an upper space above the molten metal held in the first reservoir chamber 31. The opening 46 is usually closed by a cover 45 which is lifted vertically by an actuator or cylinder 43 as necessary for allowing insertion of the skimming plate 41. Beneath the skimming plate 41, a bucket 44 is provided for receiving contaminants ladled out by the skimming plate 41.

In operation, when the controller 300 issues a command to the cylinder 43, it lifts the cover 45 upward to open the opening 46. The cylinder 42 is also responsive to a command from the controller 300 to move the drum 47 upward slightly, as shown by a broken line in FIG. 3. The drum 47 then extends the rolled blade spring to insert the skimming plate 41 into the upper space above the first reservoir chamber 31. When the blade spring is fully extended so that the skimming plate 41 reaches the innermost portion of the first reservoir chamber 31, the cylinder 42 shortens its cylinder shaft to hold the skimming plate 41 horizontally so that it is partially immersed in the molten metal held in the first reservoir chamber 31. The blade spring is then rolled up inside the drum 47 so that the skimming plate 41 returns back to the opening 46 while skimming the molten metal in the first reservoir chamber 31. This will cause contaminants existing in the surface of the molten metal to be collected by the skimming plate 41 to the opening 46, which are, in turn, discharged along a lower surface 46*a* of the opening 46 into the bucket 44. This sequence of operations is preferable to be carried out cyclically. For example, a timer may be used to actuate the contaminant remover device 40 automatically at regular time intervals.

The return material supply device 50 is, as clearly shown in the drawing, mounted opposite the contaminant remover device 40, and includes a conveyer 52 arranged outside the furnace body 10. The conveyer 52 has a carrier 51 for lifting a material toward an inlet port 55 formed in a rear wall of the furnace body 10. Upon reaching the inlet port 55, the carrier 51 is turned to feed the material into the first reservoir chamber 31.

A door 55 is provided in the inlet port 55 which is opened vertically by an actuator or cylinder 53.

In operation, when supplying a return material into the first reservoir chamber 31, it is placed on the carrier 51 being on standby near the ground, and then the conveyer 52 is started. Additionally, the cylinder 53 is also started to open the door 54, exposing the inlet port to the air. When the carrier 51 travels vertically and reaches near the inlet port 55, it will cause the carrier 51 to be turned to drop the return material along an inclined lower surface of the inlet port 55 into the first reservoir chamber 31. Afterwards, the carrier 51 is returned by the conveyer 51 back to its standby position near the ground. The door 54 is then closed by the cylinder 53. In this way, the return material is supplied to the furnace apparatus 200 as required. When the return material is not supplied, the inlet port 55 is, as mentioned above, closed by the door 54, thereby minimizing exposure of molten metal to the air and contamination of the molten metal with impurities.

While the present invention has been disclosed in terms of the preferred embodiment in order to facilitate better understanding thereof, it should be appreciated that the invention can be embodied in various ways without departing from the principle of the invention. Therefore, the invention should be understood to include all possible embodiments and modifications to the shown embodiments which can be embodied without departing from the principle of the invention as set forth in the appended claims.

For example, while in the above embodiment, the dipping burner 20 and the electric heater 21 are installed in the third reservoir chamber 33, the present invention is in no way limited to same. The dipping burner 20 and the electric heater 21 may be disposed within the first reservoir chamber 31 or the third reservoir chamber 33. Particularly, it is possible to install additional burner or heater within the third reservoir chamber 33 to finely adjust the temperature of molten metal so as to maintain it at a constant level. This arrangement is very suitable for the fine adjustment of temperature of the molten metal since the third reservoir chamber 33 is smaller in volume than the second reservoir chamber 32.

What is claimed is:

1. A method for holding molten metal within a furnace comprising;

setting a level of molten metal in the furnace to a given level at which an upper wall of the furnace contacts a surface of the molten metal; and generating inert gas in the molten metal;

whereby oxide in the molten metal rises to the surface of the molten metal.

2. A method for removing oxide in molten metal held within a furnace, the furnace including a reservoir chamber having an upper wall including an inclined wall surface leading to an inlet port, the inlet port communicating with the reservoir chamber, the method comprising:

setting a level of molten metal in the reservoir chamber to a given level so that the inclined wall surface contacts a surface of the molten metal, and generating inert gas in the molten metal such that oxide in the molten metal rises to the surface of the molten metal and moves along the inclined wall surface so as to be collected at the inlet port.

* * * * *